US005304105A

United States Patent [19]

Hsieh

[11] Patent Number: 5,304,105

[45] Date of Patent: Apr. 19, 1994

[54] EXERCISE STAIR DEVICE

[76] Inventor: Kuo C. Hsieh, P.O. Box 82-144, Taipei, Taiwan

[21] Appl. No.: 35,322

[22] Filed: Mar. 22, 1993

[51] Int. Cl.[5] ..... A63B 21/008

[52] U.S. Cl. ..... 482/53; 482/111; 482/80

[58] Field of Search ..... 482/79, 80, 111, 112, 482/113, 52, 53, 148, 57

[56] References Cited

U.S. PATENT DOCUMENTS 4,204,675 5/1980 McGinnis ..... 482/80

5,186,700 2/1993 Wang ..... 482/111

FOREIGN PATENT DOCUMENTS 2261989 7/1974 Fed. Rep. of Germany .

*Primary Examiner*—Stephen R. Crow

*Attorney, Agent, or Firm*—Alfred Lei

[57] ABSTRACT

This invention relates to an exercise stair device and in particular to one mainly including a base having a cavity at the bottom and a raised portion with two recesses, two inflatable balls each disposed in a corresponding one of the recesses and being communicated with each other via a U-shaped tube, a cover engaged with the cavity of the base, and two pedals pivotally mounted on the base and each having spherical protuberance at the bottom adapted to be received in the corresponding one of the recesses of the base, whereby when one of the pedals is pressed downward on the corresponding inflatable ball, the inflatable ball will be squeezed by the pedal thereby forcing the air in the inflatable ball to go into the other inflatable ball and therefore lifting the other one of the pedals.

1 Claim, 3 Drawing Sheets

EXERCISE STAIR DEVICE

BACKGROUND OF THE INVENTION

This invention relates to an exercise stair device.

While the type and extent of the exercise individuals practice often depends on a physician's recommendations, it is recognized that exercise should not only be regular but also sufficiently strenuous to cause the heart beat to be accelerated for a reasonable but substantial interval.

For many, exercise outdoors is preferred with jogging popular while others enjoy brisk walks. For others, however, weather conditions and the character of the neighborhood make necessary to use a stationary bicycle or a treadmill exerciser.

Such devices, however, are monotonous to use as a consequence of which, interest in an exercise program is often lost so that what is needed is a way to make the use of such devices a pleasurable interval with the exercise automatically taking place. Besides, these devices are especially designed for use by men only.

It is, therefore, an object of the present invention to provide an exercise stair device which may obviate and mitigate the above-mentioned drawbacks.

SUMMARY OF THE INVENTION

This invention relates to an improved exercise stair device.

It is the primary object of the present invention to provide an exercise stair device which is especially designed for use by women.

It is another object of the present invention to provide an exercise stair device which will produce less reaction.

It is still another object of the present invention to provide an exercise stair device which is simple in construction.

It is still another object of the present invention to provide an exercise stair device which is easy to maintain.

It is a further object of the present invention to provide an exercise stair device which is economic to produce.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claim following.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
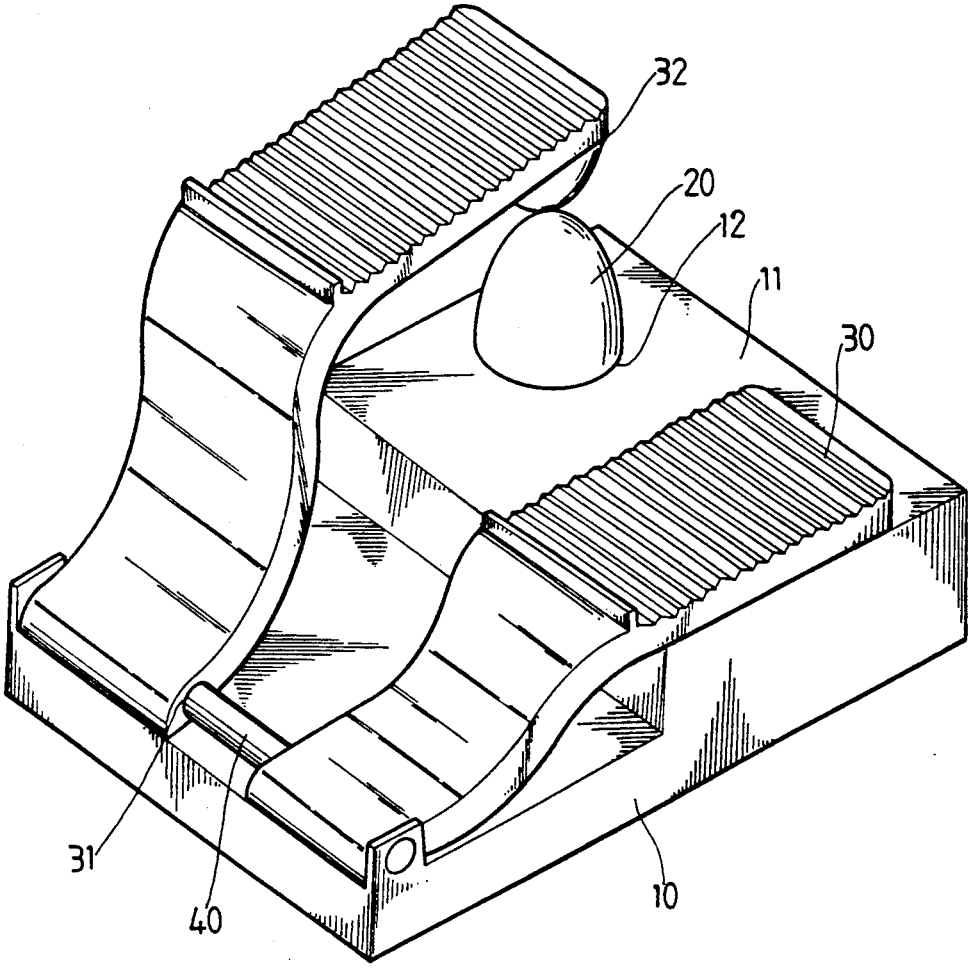
FIG. 1 is a perspective view of the present invention.
Figure 2:
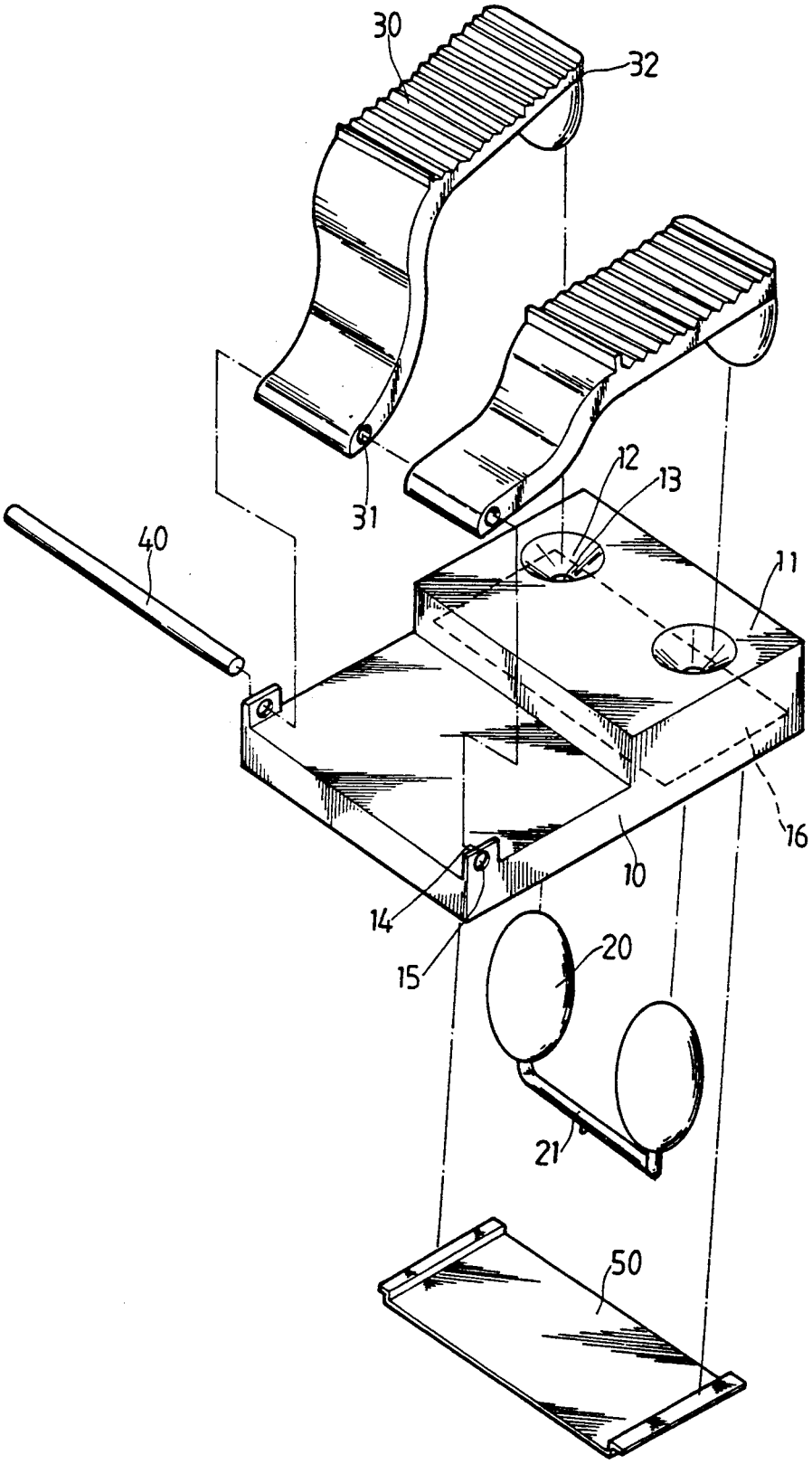
FIG. 2 is an exploded view of the present invention.

With reference to the drawings and in particular to FIGS. 1 and 2 thereof, the exercise stair device according to the present invention mainly comprises a base 10, two pedals 30, two inflatable balls 20, a cover 50, and an elongated rod 40. The base 10 is formed with a raised portion 11 having two recesses 12 thereon. Each of the recesses 12 is provided with a hole 13. Further, the base 10 has a cavity 16 at the bottom and two lugs 14 each having a hole 15. The two inflatable balls 20 are each disposed in a corresponding recess 11 and are in communication with each other via a U-shaped tube 21. The cover 50 is engaged with the bottom of the base 10 so as to close the cavity 16. The two pedals 30 having a hole 31 are pivotally mounted on the base 10 by inserting the elongated rod 40 through the holes 15 of the lugs 14 of the base 10 and the holes 31 of the pedals 30. In addition, the bottom of the pedal 30 has a spherical protuberance 32 adapted to be received in the recess 12 of the base 11. The recess 12 is designed to receive and protect the inflatable ball 20.

Figure 3A:
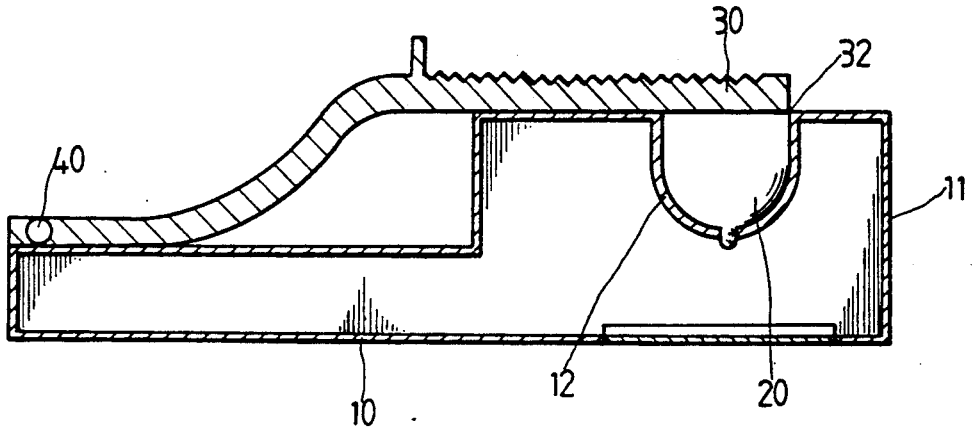
FIGS. 3A and 3B show the working principle of the present invention.
Figure 3B:
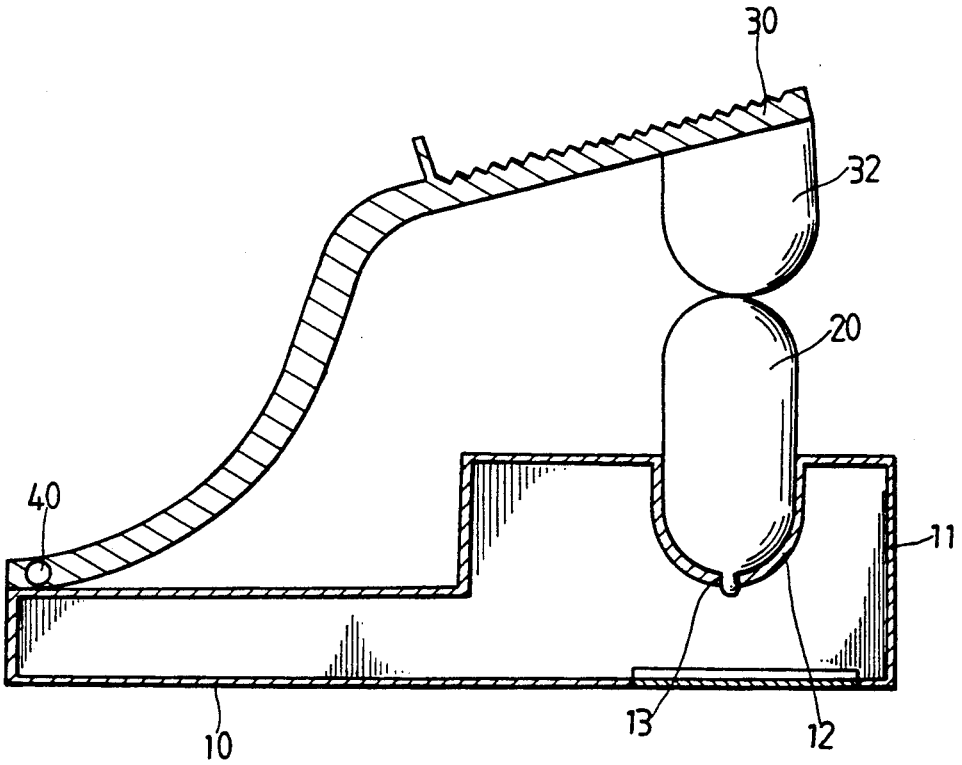

Referring to FIGS. 3A and 3B, as one of the pedals 30 is pressed downward on an inflatable ball 20, the inflatable ball 20 will be squeezed by the bottom 32 of the pedal 30 thereby forcing the air in the inflatable ball 20 to go into the other inflatable ball 20 and therefore lifting the other one of the pedals 30.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An exercise stair device comprising:

a base having cavity at the bottom and a raised portion with two recesses thereon, each of said recesses being formed with a hole;

two inflatable balls each disposed in a corresponding one of said recesses and being communicated with each other via a U-shaped tube;

a cover engaged with the cavity of said base; and two pedals pivotally mounted on said base and each having spherical protuberance at the bottom adapted to be received in the corresponding one of the recesses of said base;

whereby when one of said pedals is pressed downward on the corresponding inflatable ball, the inflatable ball will be squeezed by the pedal thereby forcing the air in the inflatable ball to go into the other inflatable ball and therefore lifting the other one of the pedals.

* * * * *